US009307314B2

(12) United States Patent
Kim et al.

(10) Patent No.: US 9,307,314 B2
(45) Date of Patent: Apr. 5, 2016

(54) ELECTRONIC DEVICE WITH SIDE ACOUSTIC EMISSION TYPE SPEAKER DEVICE

(71) Applicant: Samsung Electronics Co., Ltd., Gyeonggi-do (KR)

(72) Inventors: Ji-Hoon Kim, Gyeongsangnam-do (KR); In-Ho Jeong, Gyeongsangnam-do (KR); Jong-Heon Ha, Gyeongsangnam-do (KR); Ho-Yun Lee, Busan (KR); Bong-Hee Kang, Gyeongsangnam-do (KR); Joong-Hak Kwon, Busan (KR); Ki-Won Kim, Gyeonggi-do (KR); Byoung-Hee Lee, Seoul (KR); Ho-Chul Hwang, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/303,495

(22) Filed: Jun. 12, 2014

(65) Prior Publication Data

US 2014/0369533 A1 Dec. 18, 2014

(30) Foreign Application Priority Data

Jun. 12, 2013 (KR) ..... 10-2013-0066932
May 26, 2014 (KR) ..... 10-2014-0063029

(51) Int. Cl.
*H04R 25/00* (2006.01)
*H04R 1/20* (2006.01)
(Continued)

(52) U.S. Cl.
CPC ..... *H04R 1/345* (2013.01); *H04R 1/2842* (2013.01); *H04R 2499/11* (2013.01); *H04R 2499/15* (2013.01)

(58) Field of Classification Search
CPC .... H04B 1/3833; H04M 1/23; H04M 1/0214; H04M 1/035; H04R 1/00; H04R 1/02; H04R 1/023; H04R 1/2857; H04R 1/34; H04R 1/345; H04R 2205/24; H04R 2400/03; H04R 2499/11
USPC ..... 381/150, 160, 334, 335, 336, 345; 455/347, 350, 575.1
See application file for complete search history.

(56) References Cited

U.S. PATENT DOCUMENTS 4,142,603 A * 3/1979 Johnson ..... 181/148
4,325,454 A * 4/1982 Humphrey ..... 181/145
4,800,983 A * 1/1989 Geren ..... 181/155
(Continued)

FOREIGN PATENT DOCUMENTS

KR 10-2011-0090697 8/2011
KR 10-2013-0097590 9/2013

OTHER PUBLICATIONS

Korean Office Action dated Mar. 31, 2014 in connection with Korean Patent Application No. 10-2013-0066932, 7 pages.

*Primary Examiner* — Khai N Nguyen

(57) ABSTRACT

Disclosed is an electronic device including: a housing having a sound emission hole formed in at least one side thereof; a speaker module which is at least partially accommodated in the housing; and a sound reflection surface formed inside the housing and obliquely facing the speaker module. A sound emitted from the speaker module can be reflected by the sound reflection surface to the sound emission hole. The side acoustic emission type speaker device and the electronic device including the same can be variously implemented.

20 Claims, 5 Drawing Sheets

(51) Int. Cl.
*H04R 1/34* (2006.01)
*H04R 1/28* (2006.01)

(56) References Cited

U.S. PATENT DOCUMENTS 6,349,792 B1 * 2/2002 Smith et al. ..... 181/156
7,093,688 B2 * 8/2006 Lee ..... 181/155
2001/0052284 A1 * 12/2001 Kondo et al. ..... 84/718
2002/0011379 A1 * 1/2002 Taylor ..... 181/155
2004/0071286 A1 * 4/2004 Asaro ..... 379/433.01
2007/0223745 A1 * 9/2007 Feng et al. ..... 381/160
2008/0176609 A1 * 7/2008 Kim et al. ..... 455/575.1
2012/0298441 A1 * 11/2012 Lin et al. ..... 181/199
2013/0002109 A1 * 1/2013 Gloria ..... 312/244
2013/0223655 A1 8/2013 Lee et al.

* cited by examiner

ELECTRONIC DEVICE WITH SIDE ACOUSTIC EMISSION TYPE SPEAKER DEVICE

CROSS-REFERENCE TO RELATED APPLICATION(S) AND CLAIM OF PRIORITY

The present application is related to and claims the priority under 35 U.S.C. §119(a) to Korean Application Serial No. 10-2013-0066932, which was filed in the Korean Intellectual Property Office on Jun. 12, 2013, and Korean Application Serial No. 10-2014-0063029, which was filed in the Korean Intellectual Property Office on May 26, 2014, the entire content of which is hereby incorporated by reference.

TECHNICAL FIELD

Various embodiments of the present disclosure discussed herein relate to an electronic device provided with a sound device.

BACKGROUND

Typically, electronic devices refers to devices that perform a specific function according to a program installed therein such as an electronic scheduler, a portable multimedia reproducer, a mobile communication terminal, a tablet PC, a video/audio device, a desktop computer, a laptop computer, and a vehicle navigation system, including a home appliance. For example, such electronic devices may output information stored therein as a sound or an image. As integration densities of electronic devices have increased and ultra-high speed and large capacity wireless communication has been popularized, various functions have recently been incorporated in a single mobile communication terminal. For example, not only a communication function, but also an entertainment function such as game, a multimedia function such as music/video reproduction, a communication and security function for mobile banking or the like, a schedule management or e-wallet function, and the like, are integrated in a single electronic device.

Such electronic devices may include a display device for outputting a picture, a speaker device for outputting sounds, and the like. In mounting a speaker device, a slim electronic device has a narrow speaker device space. Thus, when a micro-speaker is mounted, a sound emission hole may be formed on a side opposite to the display device. For example, assuming that the display device is positioned on a front side, the sound emission hole may be formed in the rear side. When the sound emission hole is formed in the rear side, a low frequency voice range is hardly affected in sound characteristic due to relatively good diffraction. However, a high frequency voice range may be degraded in sound characteristic on the front side of the electronic device where a user is positioned due to a high straight advancing property. A side acoustic emission type speaker device may be provided in order to alleviate such degradation of sound characteristic.

SUMMARY

Even if a side emission type speaker device is mounted in order to alleviate damping of sounds in a high frequency voice range in a slim electronic device, a sound in the high frequency voice range band may be more damped than a sound in the low frequency voice range band since the vibration direction of a vibration unit of the micro-speaker and a sound passage extending direction are orthogonal to each other.

To address the above-discussed deficiencies, it is a primary object of certain embodiments of the present disclosure to provide an electronic device which is provided with a side acoustic emission type speaker device capable of improving a sound characteristic of a high frequency voice range.

According to various embodiments of the present disclosure, a electronic device includes: a housing having a sound emission hole formed in at least one side thereof; a speaker module which is at least partially accommodated in the housing; and a sound reflection surface formed inside the housing and obliquely facing the speaker module. A sound emitted from the speaker module is reflected by the sound reflection surface to the sound emission hole.

The electronic device can further include an enclosure case that defines a resonance space while enclosing the speaker module.

The housing of the electronic device can provide a part of the enclosure case of the side acoustic emission type speaker device.

The sound reflection surface of the electronic device can form a sound reflection surface of the side acoustic emission type speaker device.

An electronic device according to various embodiments of the present disclosure is provided with a side acoustic emission type speaker device and a sound reflection surface is formed on an inner surface of an enclosure case (or an inner surface of a housing of the electronic device that forms a resonance space so that a sound can be reflected to a sound emission hole. For example, a sound of a high frequency voice range having a high straight advancing property can be smoothly output to a sound emission hole so that the quality of sound in the high frequency voice range can be improved. In addition, according to various embodiments of the present disclosure, an enclosure case of a speaker device can be implemented by constituent elements, such as the housing of the electronic device, a structure inside the housing, or a circuit board, to contribute to miniaturization of the electronic device.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
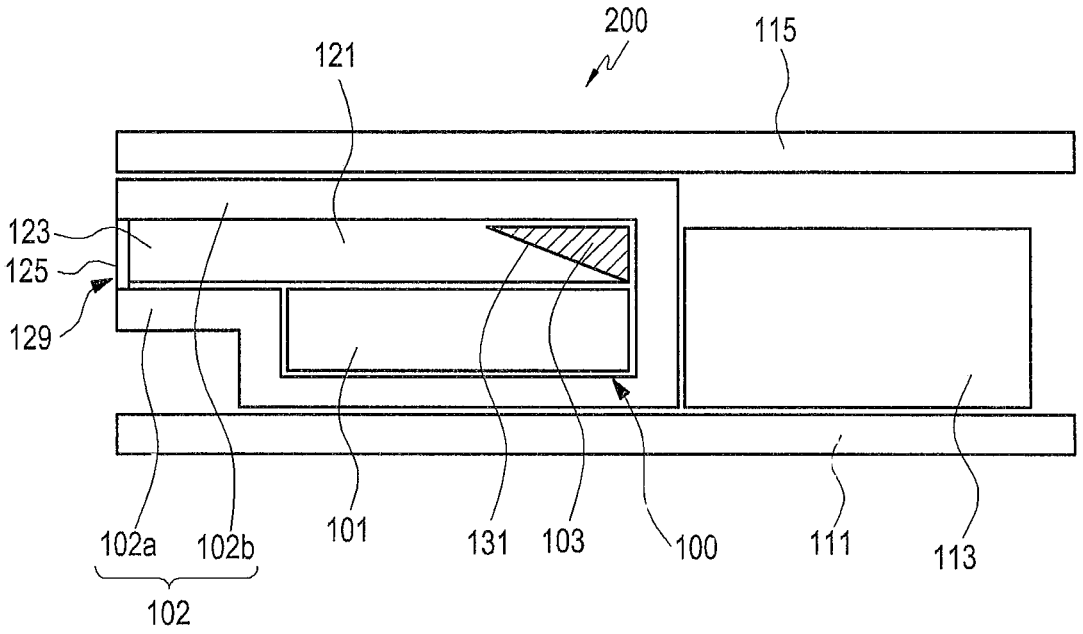
FIG. 1 is a schematic cross-sectional view illustrating an electronic device according to embodiments of the present disclosure.

FIGS. 1 through 6, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged wireless communications device. Various changes can be made to the present disclosure and various embodiments may be conceived. Some embodiments will be described in detail with reference to the drawings. However, it should be understood that the present disclosure is not limited to the specific embodiments, but the present disclosure includes all modifications, equivalents, and alternatives within the spirit and the scope of the present disclosure.

Although the terms including an ordinal number such as first, second, and so forth, can be used for describing various elements, the structural elements are not restricted by the terms. The terms are only used to distinguish one element from another element. For example, without departing from the scope of the present disclosure, a first structural element may be named a second structural element. Similarly, the second structural element also may be named the first structural element. As used herein, the term "and/or" includes any and all combinations of one or more associated items.

The relative terms, such as a front surface, a rear surface, an upper surface, and a lower surface, which are described with reference to the drawings may be replaced by ordinal numbers such as first and second. In the ordinal numbers such as first and second, their order are determined in the mentioned order or arbitrarily and may not be arbitrarily changed if necessary.

The terms used in this application merely are for the purpose of describing particular embodiments and are not intended to limit the present disclosure. Singular forms are intended to include plural forms unless the context clearly indicates otherwise. In the description, it should be understood that the terms "include" or "have" indicate existence of a feature, a number, a step, an operation, a structural element, parts, or a combination thereof, and do not previously exclude the existences or probability of addition of one or more another features, numeral, steps, operations, structural elements, parts, or combinations thereof.

Unless defined differently, all terms used herein, which include technical terminologies or scientific terminologies, have the same meaning as that understood by a person skilled in the art to which the present disclosure belongs. Such terms as those defined in a generally used dictionary are to be interpreted to have the meanings equal to the contextual meanings in the relevant field of art, and are not to be interpreted to have ideal or excessively formal meanings unless clearly defined in the present specification.

In the present disclosure, an electronic device can be a random device, and the electronic device can be called a terminal, a portable terminal, a mobile terminal, a communication terminal, a portable communication terminal, a portable mobile terminal, a display device or the like.

For example, the electronic device can be a smartphone, a portable phone, a game player, a TV, a display unit, a heads-up display unit for a vehicle, a notebook computer, a laptop computer, a tablet Personal Computer (PC), a Personal Media Player (PMP), a Personal Digital Assistants (PDA), and the like. The electronic device can be implemented as a portable communication terminal which has a wireless communication function and a pocket size. Further, the electronic device can be a flexible device or a flexible display unit.

The electronic device can communicate with an external electronic device, such as a server or the like, or perform an operation through an interworking with the external electronic device. For example, the electronic device can transmit an image photographed by a camera and/or position information detected by a sensor unit to the server through a network. The network can be a mobile or cellular communication network, a Local Area Network (LAN), a Wireless Local Area Network (WLAN), a Wide Area Network (WAN), an Internet, a Small Area Network (SAN) or the like, but is not limited thereto.

According to various embodiments of the present disclosure, an electronic device includes: a housing having a sound emission hole formed in at least one side thereof; a speaker module which is at least partially accommodated in the housing; and a sound reflection surface formed inside the housing and obliquely facing the speaker module. A sound emitted from the speaker module is reflected by the sound reflection surface to the sound emission hole.

In an embodiment, the electronic device further includes: a first enclosure mounted to face a first surface of the speaker module; a resonance space enclosed by an inner surface of the first enclosure and the speaker module; and a sound passage formed in the first enclosure and connected from the resonance space to the sound emission hole.

In the electronic device as described above, the sound reflection surface can be formed on the inner surface of the first enclosure.

In another embodiment, the electronic device as described above further includes a mesh attached to an end of the sound passage on an outer surface of the first enclosure.

In a still another embodiment, the electronic device as described above further includes: an opening formed through the housing; and a second enclosure mounted to face a second surface of the speaker module. The first enclosure can be mounted on the inner surface of the housing to face the opening and the speaker module is disposed in the opening between the first and second enclosures.

In a still another embodiment, the second enclosure includes a metal plate that faces the speaker module.

The electronic device as described above can further include: a circuit board mounted to face the second surface of the speaker module inside the housing; and a sealing member interposed between the first enclosure and the circuit board. The sealing member can be disposed around the speaker module.

In another embodiment, the first enclosure is formed to be integrated with the housing.

In a yet another embodiment, the electronic device as described above further includes: an enclosure case that defines a resonance space that surrounds a circumference of the speaker module which is seated on an inner surface of the enclosure case. The sound reflection surface can be formed on the inner surface of the enclosure case.

In a yet another embodiment, the enclosure case includes a lower enclosure case part on which the speaker module is seated, and an upper enclosure case part coupled to face the lower enclosure case part, and the sound reflection surface can be formed on an inner surface of the upper enclosure case part.

In the electronic device as described above, the sound reflection surface can be formed around the resonance space, except in a direction where the sound emission hole is formed inside the resonance space.

FIG. 1 is a schematic cross-sectional view illustrating an electronic device according to embodiments of the present disclosure.

The electronic device 200 can include a side acoustic emission type speaker device 101 accommodated in housings 111 and 115. In the example show in FIG. 1, reference numerals "111" and "115" indicate the housings. However, in another embodiment, the constituent elements indicated by reference numerals "111" and "115" can be other structures disposed on a circuit board or within the housings. For example, the constituent element indicated by reference numeral "113" can be constituted by a battery pack or an integrated circuit (IC) chip, and "other structures disposed within the housings" can include a diaphragm structure which separates the speaker device 101 and the IC chip.

The side acoustic emission type speaker device 100 can include: a speaker module provided with a magnetic circuit and a vibration body to generate a sound, for example, a micro-speaker 101; an enclosure case 102 which encloses at least a part of the micro-speaker 101 that is seated on an inner surface of the enclosure case 102; a sound emission hole 129 formed on a lateral side of the enclosure case 102; and a sound reflection surface 131 positioned on an upper inner surface of the enclosure case 102. The sound reflection surface 131 can reflect the sound generated from the micro-speaker 101 to the sound emission hole 129 side. The enclosure case 102 can surround the circumference of the micro-speaker 101 and form a resonance space 121 at least on a first surface of the micro-speaker 101. The sound reflection surface 131 can be formed by a shape of the enclosure case 102 itself. According to an embodiment, the sound reflection surface 131 is formed by attaching a reflection member 103 to the upper inner surface of the enclosure case 102.

The micro-speaker 101 provided in the speaker device 100 can include a magnetic circuit including a yoke and a magnet within a frame, a voice coil positioned in an air gap of the magnetic circuit, a side vibration plate and a center vibration plate which are vibrated by the voice coil, a suspension that guides movements of the voice coil and the vibration plates, and a terminal pad that receives an electric circuit from an outside such that the electric signal can be transmitted to the voice coil through the suspension. For example, the micro-speaker 101 can be implemented similarly to a conventional micro-speaker.

The enclosure case 102 can include a lower enclosure case part 102*a* and an upper enclosure case part 102*b*. The micro-speaker 101 can be seated on an inner surface of the lower enclosure case part 102*a*, and the upper enclosure case part 102*b* can be coupled with the lower enclosure case part 102*a* while pressing a top surface of the micro-speaker 101. The sound emission hole 129 that emits the sound to the outside can be formed on a lateral side of the enclosure case 102. A part of the sound emission hole 129 can be formed in the lower enclosure case part 102*a* and the remaining part can be formed in the upper enclosure case part 102*b*. The sound emission hole 129 can be connected with the resonance space 121 through a sound passage 125 formed by coupling the lower enclosure case part 102*a* and the upper enclosure case part 102*b*. A mesh 125 can be installed in the sound emission hole 129 or the sound passage 123 between the lower and upper enclosure case parts 102*a* and 102*b* so as to prevent foreign matter from flowing into the inside of the enclosure case 102 through the sound emission hole 129. The present embodiment exemplifies a structure in which the mesh 125 is installed in the sound emission hole 129.

The sound reflection surface 131 can be formed on the inner surface of the upper enclosure case part 102*b* so as to reflect the sound emitted from the micro-speaker 101 toward the sound emission hole 129. The sound reflection surface 131 can be fabricated as a separate member using a plastic injection-molded product or a metal material and attached to the inner surface of the upper enclosure case part 102*b*. Alternatively, the sound reflection surface 131 can be formed integrally with the upper enclosure case part 102*b* by designing an injection mold such that the sound reflection surface 131 can be formed when the upper enclosure case part 102*b* is injection-molded.

The sound reflection surface 131 can be formed, for example, around the resonance space 121, except the side where the sound emission hole 129 is formed, such as over remaining three sides on the inner surface of the upper enclosure case part 102*b*. Such a structure will be discussed below with reference to, for example, FIG. 2. When the sound reflection surface 131 is formed over three sides on the inner surface of the upper enclosure case part 102*b*, a wider area capable of reflecting the sound emitted from the micro-speaker 101 can be obtained.

In forming the sound reflection surface 131 as described above, the ratio of an area occupied by the upper enclosure case part 102*b* in the inner surface can be variously changed. In addition, the sound reflection surface 131 can be implemented as a surface inclined to a sound emission direction of the micro-speaker 101 or a curved surface in consideration of a distribution of sound pressure emitted from the micro-speaker 101 or a position or a size of the sound emission hole 129.

In describing the various embodiments of the present disclosure below, components that can be easily understood through the foregoing embodiment will be assigned the same reference numerals of the drawings or omitted and the detailed descriptions thereof can also be omitted.

Figure 2:
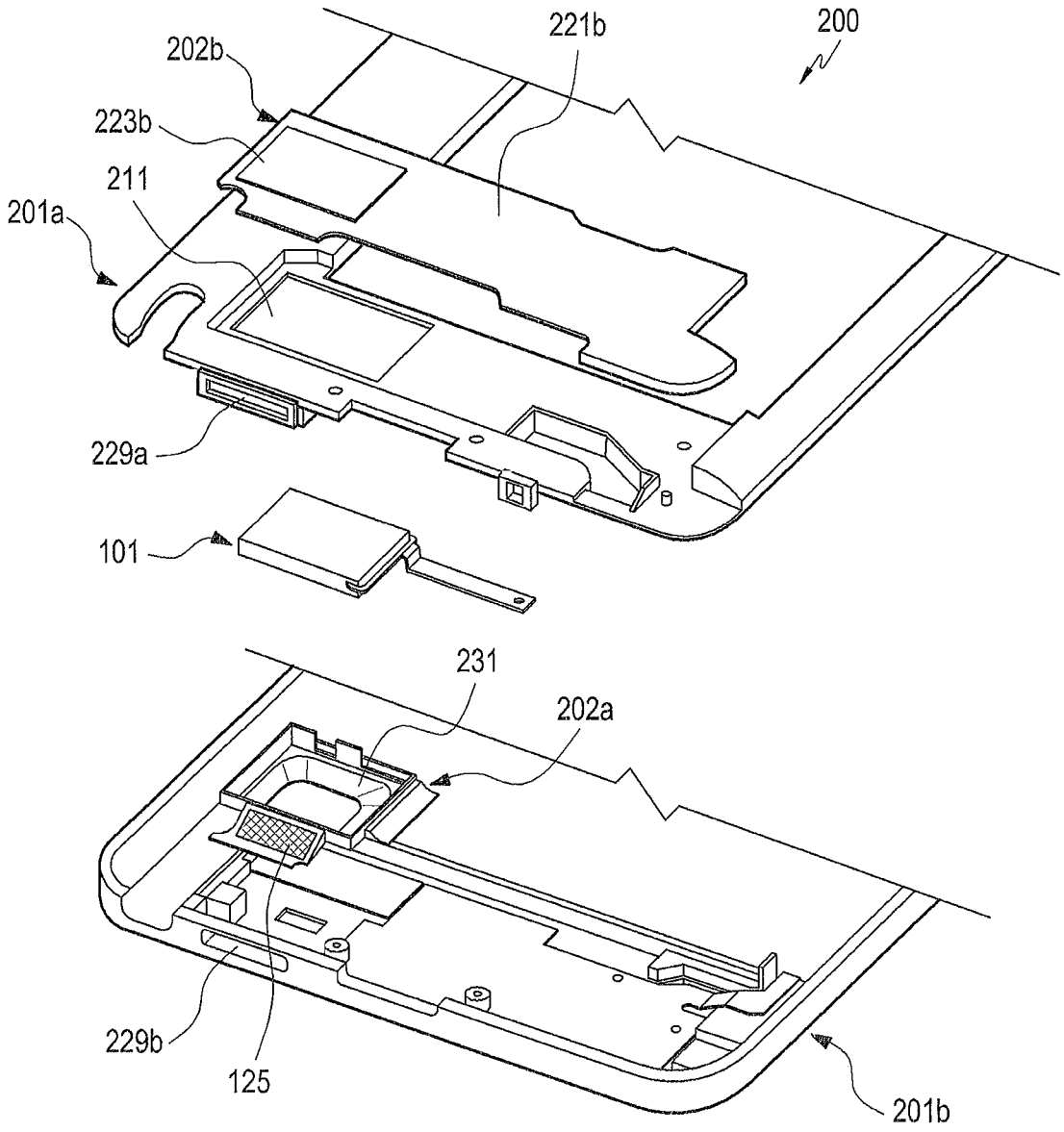
FIG. 2 is an exploded perspective view illustrating a state where a side acoustic emission type speaker device is installed in an electronic device according to embodiments of the present disclosure.
Figure 3:
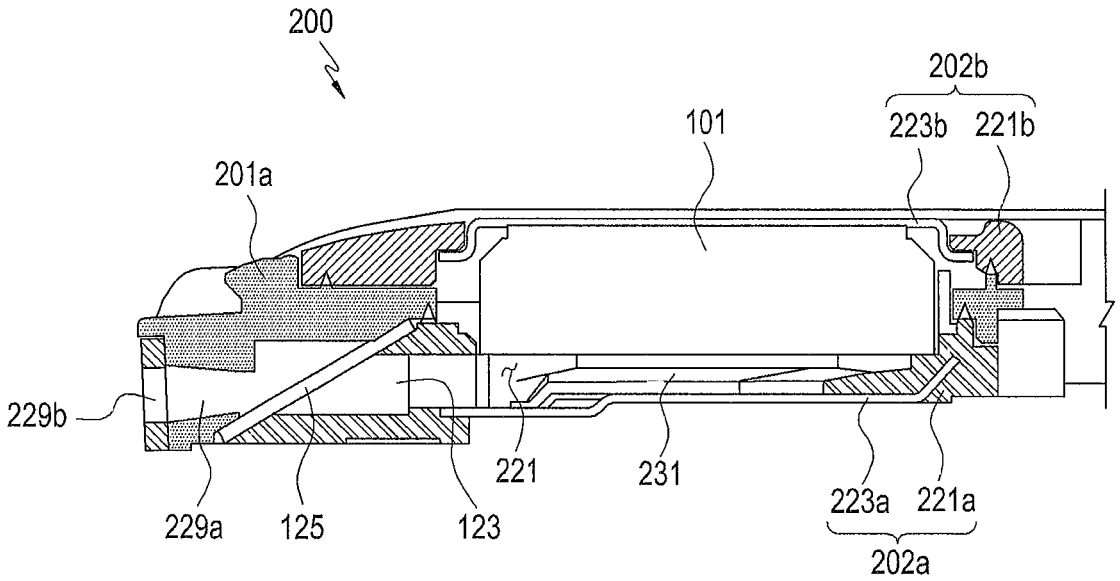
FIG. 3 is a cross-sectional view illustrating a state in which a side acoustic emission type speaker device is installed in an electronic device according to embodiments of the present disclosure.

FIG. 2 is an exploded perspective view illustrating a state where a side acoustic emission type speaker device is installed in an electronic device according to embodiments of the present disclosure. FIG. 3 is a cross-sectional view illustrating a state in which a side acoustic emission type speaker device is installed in an electronic device according to embodiments of the present disclosure.

In the foregoing embodiment, descriptions have been made on the configuration of the side acoustic emission type speaker device in which a speaker module is provided inside the enclosure case constituted with the lower and upper enclosure case parts. According to the various embodiments of the present disclosure, in providing the above-described side acoustic emission type speaker device in an actual electronic device, a structure of the electronic device itself such as a part of a housing or the like can form the enclosure case of the side acoustic emission type speaker device.

Referring to FIGS. 2 and 3, an electronic device 200 can include housings 201*a* and 201*b*, a speaker module accommodated in the housings 201*a* and 201*b*, for example, the micro-speaker 101 as described above, a sound emission hole 229*a* or 229*b* formed on at one side of at least one the housings 201*a* and 201*b*, and a sound reflection surface 231 formed inside the housings 201*a* and 201*b*. A sound emitted from the micro-speaker 101 is reflected by the sound reflection surface 231 to the sound emission holes 229*a* and 229*b* to be output to the outside of the housings 201*a* and 201*b*.

The housings 201*a* and 201*b* can be configured by coupling the rear case 201*a* and the front case 201*b*, and an opening 211 is formed in the rear case 201*a* to accommodate at least a part of the micro-speaker 101. For example, the micro-speaker 101 can be disposed in a state where the side surfaces thereof are surrounded by the inner walls of the opening 211. The sound emission holes 229*a* and 229*b* can be formed on the sides of the housings 201*a* and 201*b*, respectively, to be adjacent to the opening 211. In the embodiment, the front case 201*b* is coupled to enclose at least a part of the side surfaces of the rear case 201*a*, and the sound emission holes 229*a* and 229*b* is completed when a first sound emission hole 229*a* formed in a side of the rear case 201*a* and a second sound emission hole 229*b* formed in a side of the front case 201*b* are aligned to each other.

In the housings 201*a* and 201*b*, a first enclosure 202*a* can be further disposed in which the first enclosure 202*a* is coupled to face an inner surface, for example, the inner surface of the rear case 201*a*. The first enclosure 202*a* can include a metal plate 223*a*, and an injection-molded product 221*a* formed around a metal plate 223*a*. The first enclosure 202*a* is coupled to face a first surface of the micro-speaker 101 such that a resonance space 221 enclosed by the first surface of the micro-speaker 101 and the inner surface of the first enclosure 202*a* can be formed. In the present embodiment, it is exemplified that the first enclosure 202*a* is configured by assembling the housings 201*a* and 201*b*. However, the housings 201*a* and 201*b* can be formed in a form of a single body. The first enclosure 202*a* can include a sound passage 123 that connects the resonance space 221 to the sound emission holes 229*a* and 229*b*. A mesh 125 can be attached to an end of the sound passage 123 on the outer surface of the first enclosure 202*a* so as to prevent foreign matter from flowing into the inside of the first enclosure 202*a*.

The sound reflection surface 231 can be formed inside of the housings 201*a* and 201*b*, for example, on the inner surface of the first enclosure 202*a*. In the side acoustic emission type speaker device, the direction of emitting the sound from the micro-speaker can be orthogonal to the extension direction of the sound passage. The higher the frequency band of a sound, the higher the straight advancing property of the sound. Thus, in the side acoustic emission type speaker device, a damping phenomenon can be increased in a relatively high frequency voice range as compared to a low frequency voice range. According to certain embodiments, the electronic device 200 suppresses or alleviates the damping phenomenon that can occur in the high frequency voice range by forming the sound reflection surface 231 to be inclined in relation to the sound emission direction of the micro-speaker 101 so as to reflect the sound toward the sound emission holes 229*a* and 229*b*.

The sound reflection surface 231 can be formed by attaching a separate reflection member inside the first enclosure 202*a*, or by the shape of the first enclosure 202*a* itself. In an embodiment, when the first enclosure 202*a* partially includes a metal plate, the sound reflection surface 231 is formed by bending a part of the metal plate. FIG. 3 illustrates a configuration in which the sound reflection surface 231 is formed on the inner surface of the first enclosure 202*a* by the shape of the injection-molded product 221*a* itself. As described above, the sound reflection surface 231 can be formed along the circumference of the resonance space 121, except in the direction where the sound emission holes 229*a* and 229*b* are formed, such as over remaining three surfaces on the inner surface of the first enclosure 202*a*. When the sound reflection surface 231 is formed over three sides on the inner surface of the first enclosure 202*a*, an area that reflects the sound emitted from the micro-speaker 101 can be obtained more widely.

The electronic device 200 can further include a second enclosure 202*b* coupled to the outer surfaces of the housings 201*a* and 201*b*, for example, the outer surface of the rear case 201*a*. The second enclosure 202*b* can be disposed to face the second surface of the micro-speaker 101 where the opening 211 is positioned. The second enclosure 202*b* can include a metal plate 223*b* positioned on a portion facing the micro-speaker 101 and an injection-molded product 221*b* formed around the metal plate 223*b*. As a result, the micro-speaker 101 can be accommodated in the enclosure case constituted with the first enclosure 202*a*, the rear case 201*a*, and the second enclosure 202*b*, and can output a sound through the sound emission holes 229*a* and 229*b* formed in the sides of the housing 201*a* and 201*b*. The sound emitted from the micro-speaker 101 can be reflected by the sound reflection surface 231 to the sound emission holes 229*a* and 229*b*.

In certain embodiments, in configuring the enclosure case that encloses the micro-speaker 101, a sealing structure is provided between every two of the first enclosure 202*a*, the rear case 201*a* and the second enclosure 202*b* so as to prevent sound pressure from leaking out. Such a sealing structure can be implemented through a bonding structure such as ultrasonic welding or adhesion, or by disposing a sealing member such as silicon or rubber.

Figure 4:
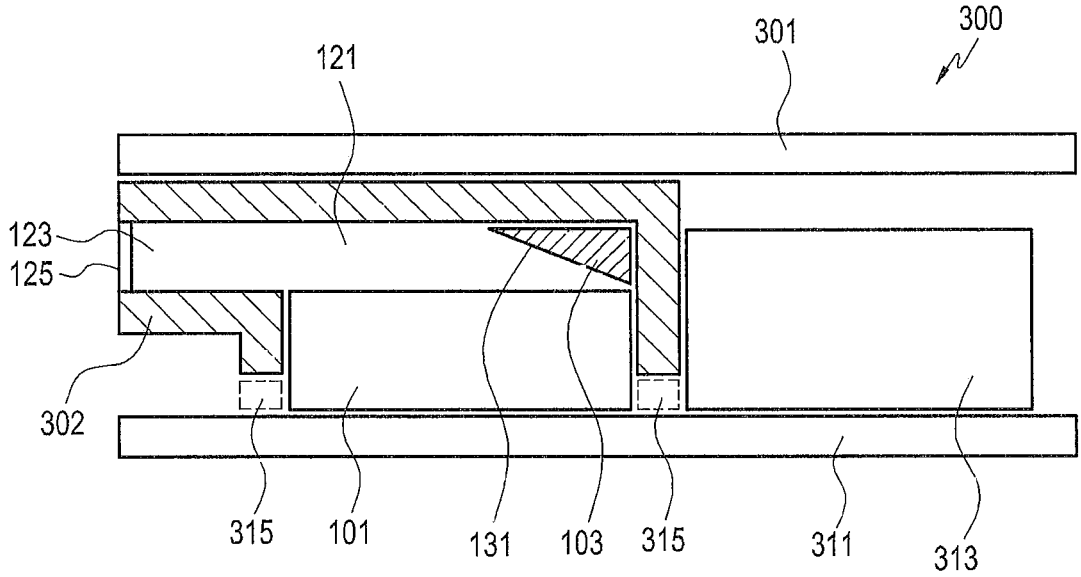
FIG. 4 is a schematic cross-sectional view illustrating another example in which a side acoustic emission type speaker device is installed in an electronic device according to embodiments of the present disclosure.

FIG. 4 is a schematic cross-sectional view illustrating another example in which a side acoustic emission type speaker device is installed in an electronic device according to embodiments of the present disclosure.

The electronic device 300 is different from the foregoing embodiments in that another constituent element disposed inside the housing 301, for example, a circuit board 311, constitutes a part of the enclosure case of the micro-speaker 101. For example, in the electronic device 300 of the present embodiment, the circuit board 311 can replace the second enclosure 202*b* of the foregoing embodiment.

The micro-speaker 101 can be disposed inside the housing 301 in a state in which it is enclosed by a first enclosure 302. A resonance space 121 can be formed by a first surface of the micro-speaker 101 and an inner surface of the first enclosure 302, and a sound emitted from the micro-speaker 101 can be output through a sound passage 123. The first enclosure 302 can be disposed to face the inner surface of the housing 301, and various circuit devices 313 such as an IC chip, or a battery pack can be disposed on the circuit board 311. The first enclosure 302 can separate the circuit devices 313 and the micro-speaker 101.

The circuit board 311 can be coupled to face a second surface of the micro-speaker 101, and a sealing member 315 can be disposed between the first enclosure 302 and the circuit board 311. The enclosure case of the micro-speaker 101 can be configured by the first enclosure 302, the circuit board 311, and the sealing member 315. The sealing member 315 can be made of a resilient material such as silicon or rubber, and can enclose the circumference of the micro-speaker 101. As described above, a radiation member 103 can be attached inside the first enclosure 302 so as to provide a sound reflection surface 131. In another embodiment, the sound reflection surface 131 can be implemented by the shape of the first enclosure 302 itself.

Although the present embodiment exemplifies a configuration in which the first enclosure 302 faces the inner surface of the housing 301 and the circuit board 311 faces the second surface of the micro-speaker 101, the arrangement can be reversed. For example, the first enclosure 302 can be installed to face the circuit board 311 and the inner surface of the housing 301 can be installed to face the second surface of the micro-speaker 101.

Figure 5:
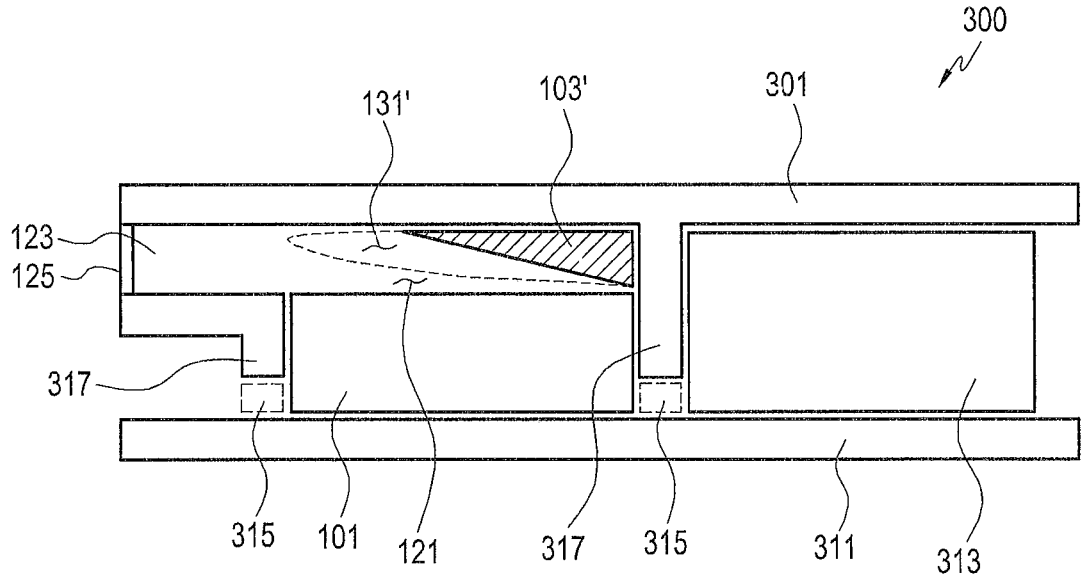
FIG. 5 is a schematic cross-sectional view illustrating another example in which a side acoustic emission type speaker device is installed in an electronic device according to embodiments of the present disclosure.

FIG. 5 is a schematic cross-sectional view illustrating another example in which a side acoustic emission type speaker device is installed in an electronic device according to embodiments of the present disclosure.

An electronic device 400 shown in FIG. 5 is different from the foregoing embodiments in that the first enclosure 302 of the foregoing embodiments is a structure that is integrally implemented in some of constituent elements of the electronic device 400 such as the housing 301.

A diaphragm structure 317 that encloses the micro-speaker 101 can be formed on the inner surface of the housing 301. For example, the first enclosure 302 of the foregoing embodiments is implemented by the diaphragm structure 317 formed in the housing 301 in the present embodiment. The resonance space 121 can be formed by the inner surface of the diaphragm structure 317 and the first surface of the micro-speaker 101, and the diaphragm structure 317 can provide a sound passage 123 that connects the resonance space 121 to the outside of the housing 301. A mesh 125 can be attached to an end of the sound passage 123 on one side of the housing 301 so as to prevent foreign matter from flowing into the resonance space 121.

The circuit board 311 (or another part of the housing) can be coupled to the second surface of the micro-speaker 101 so as to complete the enclosure case of the micro-speaker 101. A sealing member 315 can be disposed between the diaphragm structure 317 and the circuit board 311 (or another part of the housing) so as to prevent unnecessary leakage of sound pressure. The sealing member 315 can be made of a resilient material such as silicon or rubber and can enclose the circumference of the micro-speaker 101.

Although the present embodiment exemplifies a configuration in which the diaphragm structure 317 that encloses the micro-speaker 101 is formed in the housing 301, the diaphragm structure 317 can be formed on another constituent element, for example, the circuit board 311 or a bracket that supports the circuit board 311, and the housing 301 can be coupled to face the second surface of the micro-speaker 101. Such a structural arrangement can be variously implemented in consideration of manufacturing easiness, structural stability or the like.

In addition, as illustrated in FIGS. 4 and 5, the sound reflection surface 131 or 131' can be variously implemented depending on the size and shape of the reflection member 103 or 103'. For example, the reflection member 103 can provide a sound reflection surface 131 in a form of an inclined surface directed toward the sound passage 123, as illustrated in FIG. 4. Alternatively, the reflection member 103' can provide a sound reflection surface 131' around the resonance space 121, as illustrated in FIG. 5.

Figure 6:
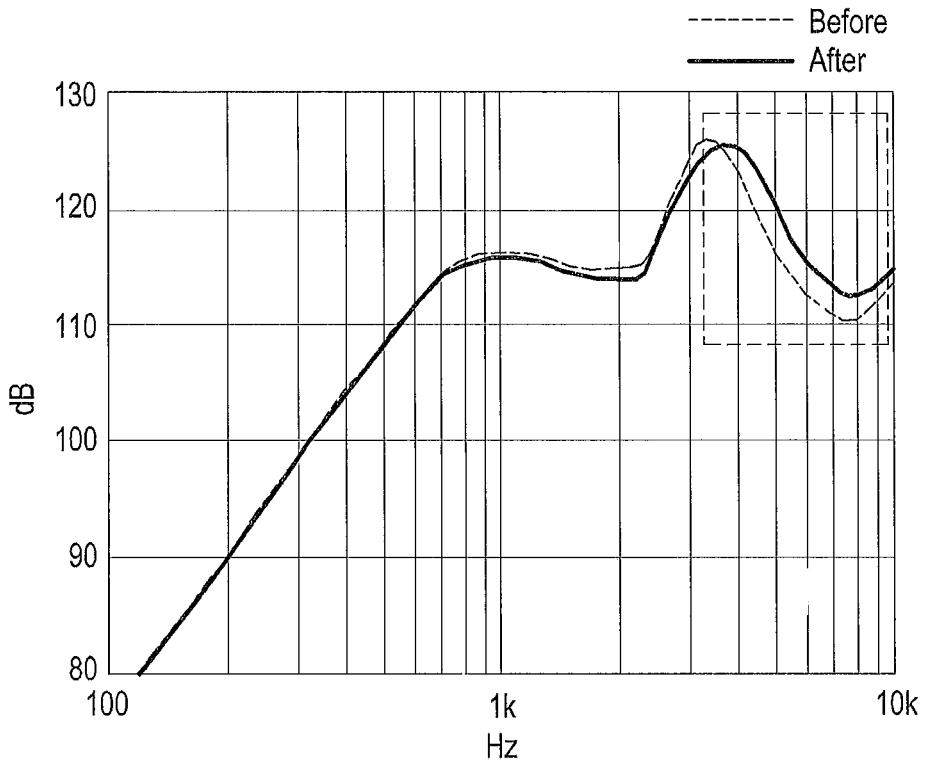
FIG. 6 is a graph illustrating sound characteristics measured for a side acoustic emission type speaker according to embodiments of the present disclosure.

FIG. 6 is a graph illustrating sound characteristics measured for a side acoustic emission type speaker according to embodiments of the present disclosure.

Referring to FIG. 6, it can be seen that when the side acoustic emission type speaker device includes a sound reflection surface according to the various embodiments of the present disclosure, in a frequency voice range around 1 kHz, the side acoustic emission type speaker device exhibits a sound pressure similar to that of a conventional side acoustic emission type speaker device, and in a relatively higher frequency range, for example, a frequency range around 6 kHz, a pressure improved by about 2 dB to 3 dB can be obtained. Such measurement results are merely examples, and a frequency voice range that improves the sound pressure can be variously exhibited according to embodiments. For example, sound characteristics different from that illustrated in FIG. 6 can be exhibited depending on the performance of the speaker module, the shape and size of the enclosure case, and the arranged shape and size of the sound reflection surface in an actually fabricated side acoustic emission type speaker device. Although some embodiments can exhibit somewhat different sound characteristics, the side acoustic emission type speaker device including the sound reflection surface according to the various embodiments of the present disclosure can improve the sound pressure in a relatively high frequency bandwidth (for example, a voice range around 6 kHz) where a secondary resonance phenomenon occurs as compared to a frequency voice range band (for example, a voice range around 1 kHz) where a primary resonance phenomenon occurs.

For example, the sound passage of the electronic device according to the various embodiments of the present disclosure can be formed in any one of the lower enclosure case part and the upper enclosure case part, or formed by coupling the lower enclosure case part and the upper enclosure case part.

The sound reflection surface of the electronic device according to the various embodiments of the present disclosure can be formed as an inclined surface or a curved surface that reflects the sound emitted from the micro-speaker to the sound emission holes. The size of the region where the sound reflection surface is formed inside the enclosure case or the shape of the sound reflection surface can be variously set according to required specifications of a side acoustic emission type speaker device or an electronic device to be manufactured.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. An electronic device comprising:

a housing having a sound emission hole formed in at least one side thereof and a resonance space;

a speaker module that is at least partially disposed in the housing; and a sound reflection surface formed inside the housing and obliquely facing the speaker module, the sound reflection surface configured to reflect a sound emitted from the speaker module to the sound emission hole, wherein the sound reflection surface is formed around the resonance space, except in a direction where the sound emission hole is formed inside the resonance space.

2. The electronic device of claim 1, further comprising:

a first enclosure disposed to face a first surface of the speaker module; and a sound passage formed in the first enclosure, wherein the resonance space is enclosed by an inner surface of the first enclosure and the speaker module and the sound passage is connected from the resonance space to the sound emission hole.

3. The electronic device of claim 2, wherein the sound reflection surface is formed on the inner surface of the first enclosure.

4. The electronic device of claim 2, further comprising:

a mesh attached to an end of the sound passage on an outer surface of the first enclosure.

5. The electronic device of claim 2, further comprising:

an opening formed through the housing; and a second enclosure mounted to face a second surface of the speaker module, wherein the first enclosure is mounted on the inner surface of the housing to face the opening and the speaker module is disposed in the opening between the first and second enclosures.

6. The electronic device of claim 5, wherein the second enclosure includes a metal plate that faces the speaker module.

7. The electronic device of claim 2, further comprising:

a circuit board mounted to face the second surface of the speaker module inside the housing; and a sealing member interposed between the first enclosure and the circuit board, wherein the sealing member is disposed around the speaker module.

8. The electronic device of claim 7, wherein the first enclosure is formed to be integrated with the housing.

9. The electronic device of claim 1, further comprising:

an enclosure case that defines the resonance space that surrounds a circumference of the speaker module, which is seated on an inner surface of the enclosure case, wherein the sound reflection surface is formed on the inner surface of the enclosure case.

10. The electronic device of claim 9, wherein the enclosure case includes a lower enclosure case part on which the speaker module is seated, and an upper enclosure case part coupled to face the lower enclosure case part, and the sound reflection surface is formed on an inner surface of the upper enclosure case part.

11. A method comprising:

emitting a sound from a speaker module that is at least partially disposed in a housing, the housing having a sound emission hole formed in at least one side thereof and a resonance space;

reflecting the sound to the sound emission hole by a sound reflection surface formed inside the housing and obliquely facing the speaker module, wherein the sound reflection surface is formed around the resonance space, except in a direction where the sound emission hole is formed inside the resonance space.

12. The method of claim 11, wherein:

a first enclosure is disposed to face a first surface of the speaker module; and a sound passage is formed in the first enclosure, wherein the resonance space is enclosed by an inner surface of the first enclosure and the speaker module and the sound passage is connected from the resonance space to the sound emission hole.

13. The method of claim 12, wherein the sound reflection surface is formed on the inner surface of the first enclosure.

14. The method of claim 12, wherein a mesh is attached to an end of the sound passage on an outer surface of the first enclosure.

15. The method of claim 12, wherein an opening is formed through the housing, and a second enclosure is mounted to face a second surface of the speaker module, and wherein the first enclosure is mounted on the inner surface of the housing to face the opening and the speaker module is disposed in the opening between the first and second enclosures.

16. The method of claim 15, wherein the second enclosure includes a metal plate that faces the speaker module.

17. The method of claim 12, wherein a circuit board is mounted to face the second surface of the speaker module inside the housing and a sealing member is interposed between the first enclosure and the circuit board, and wherein the sealing member is disposed around the speaker module.

18. The method of claim 17, wherein the first enclosure is formed to be integrated with the housing.

19. The method of claim 11, wherein an enclosure case defines the resonance space that surrounds a circumference of the speaker module, which is seated on an inner surface of the enclosure case, and wherein the sound reflection surface is formed on the inner surface of the enclosure case.

20. The method of claim 19, wherein the enclosure case includes a lower enclosure case part on which the speaker module is seated, and an upper enclosure case part coupled to face the lower enclosure case part, and the sound reflection surface is formed on an inner surface of the upper enclosure case part.

* * * * *